US005411674A

United States Patent [19]

Tagata et al.

[11] Patent Number: 5,411,674

[45] Date of Patent: May 2, 1995

[54] DETERGENT COMPOSITION HAVING A SULFOSUCCINIC AMIDE

[75] Inventors: Shuji Tagata, Kaminokawa; Fumio Sai, Utsunomiya, both of Japan

[73] Assignee: Kao Corporation, Tokyo, Japan

[21] Appl. No.: 943,123

[22] Filed: Sep. 10, 1992

Related U.S. Application Data

[63] Continuation of Ser. No. 588,832, Sep. 27, 1990, abandoned.

[30] Foreign Application Priority Data

Oct. 6, 1989 [JP] Japan ..... 1-261750

[51] Int. Cl.[6] ..... C11D 1/10; C11D 1/04; C11D 1/66; C11D 1/12

[52] U.S. Cl. ..... 252/117; 252/108; 252/121; 252/132; 252/545; 252/DIG. 1

[58] Field of Search ..... 252/108, 117, 121, 132, 252/545, DIG. 1

[56] References Cited

U.S. PATENT DOCUMENTS

| | | | |
|---|---|---|---|
| 2,954,348 | 9/1960 | Schwoeppe | 252/109 |
| 3,920,565 | 11/1975 | Morton | 252/8.75 |
| 4,704,233 | 11/1987 | Hartman et al. | 252/539 |
| 4,790,856 | 12/1988 | Wixon | 8/137 |

*Primary Examiner*—Paul Lieberman
*Assistant Examiner*—E. Higgins
*Attorney, Agent, or Firm*—Oblon, Spivak, McClelland, Maier, Neustadt

[57] ABSTRACT

A detergent composition which has an excellent detergency against muddy dirt of clothing. It comprises (a) nonionic surfactant, (b) fatty acid or salt thereof and (c) sulfosuccinic amide, and further (d) anionic surfactant as occasion demands.

5 Claims, No Drawings

DETERGENT COMPOSITION HAVING A SULFOSUCCINIC AMIDE

This application is a Continuation of application Ser. No. 07/588,832, filed on Sep. 27, 1990, now abandoned.

BACKGROUND OF THE INVENTION

1. Field of the Invention

The present invention relates to a detergent composition, particularly to a detergent composition which has excellent detergency against clothing stained with inorganic dirt.

2. Description of the Prior Art

Clothing dirt can be divided mostly into organic dirt and inorganic dirt. The organic dirt consists mainly of sebaceous dirt from the human body in case of clothing such as underwear. A detergent composition comprising a nonionic surfactant has excellent detergency against oily dirt such as sebaceous dirt.

On the other hand, the inorganic dirt consists mainly of mud originated from dust suspended in the air or soil. In general, the clothing dirt is a mixture of organic dirt and inorganic dirt.

Up to the present, various studies have been conducted in order to enhance detergency against inorganic dirt.

For example, Japanese Laid-Open No. 54-39411 and 54-130509 disclose a combined use of certain water soluble cationic surfactants. Japanese Laid-Open No. 51-142489 and 56-150048 disclose a combined use of certain amphoteric surfactants. Japanese Laid-Open No. 53-104582 discloses a combined use of carboxyalkylated alkylether-type anionic surfactants.

However, the detergents mentioned above do not have sufficient detergency against inorganic dirt, especially against mud stuck on socks, etc.

Japanese Laid-Open No. 61-236898 discloses a softening, antistatic detergent composition which comprises nonionic surfactant, mono long-chain alkyl quaternary ammonium salt and sulfo succinamate (sulfo succinic acid amide), and further anionic surfactant as occasion demands.

Though this composition is similar to the composition of the present invention, it does not have sufficient detergency against inorganic dirt.

SUMMARY OF THE INVENTION

The present inventors have made intensive studies on the detergent composition to solve the problem mentioned above and, as a result, found that detergency against muddy dirt can be synergistically enhanced by using jointly a higher fatty acid or salt thereof and a sulfosuccinic amide in combination with a nonionic surfactant as ingredients of a detergent composition. The present invention was accomplished based on the above findings.

Accordingly, the present invention provides for a detergent composition which comprises 10 to 70% by weight of (a) nonionic surfactant, 2 to 20% by weight of (b) fatty acid having 8–22 carbon atoms or salt thereof, and 1 to 40% by weight of (c) sulfosuccinic amide of the formula (I).

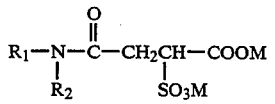

(I)

wherein $R_1$ represents $C_6$-$C_{22}$ alkyl or alkenyl, $R_2$ represents hydrogen atom, $C_1$-$C_3$ alkyl, carboxyalkyl having $C_1$-$C_3$ alkyl or 1,2-dicarboxyalkyl having $C_1$-$C_3$ alkyl, M represents alkali metal, alkaline earth metal, alkanolamine or ammonium.

DETAILED DESCRIPTION OF THE INVENTION AND PREFERRED EMBODIMENT

Although nonionic surfactants of (a) component of the invention are not limited specifically, the following compounds are illustrated for examples.

(1) Polyoxyethylene alkyl or alkenyl ether having $C_{10}$-$C_{20}$ (average) alkyl or alkenyl group, and added with 1–20 moles of ethylene oxide.

(2) Polyoxyethylene alkylphenyl ether having $C_6$-$C_{12}$ (average) alkyl group, and added with 1–20 moles of ethylene oxide.

(3) Polyoxypropylene alkyl or alkenyl ether having $C_{10}$-$C_{20}$ (average) alkyl or alkenyl group, and added with 1–20 propylene oxide.

(4) Polyoxybutylene alkyl or alkylene ether having $C_{10}$-$C_{20}$ (average) alkyl or alkenyl group, and added with 1–20 moles of butylene oxide.

(5) Nonionic surfactant having $C_{10}$-$C_{20}$ (average) alkyl or alkenyl group and added with 1–30 in sum of ethylene oxide and propylene oxide or butylene oxide (molar ratio of ethylene oxide to propylene oxide or butylene oxide is in the range of 0.1/9.9–9.9/0.1).

(6) Fatty acid alkanol amide of the formula (II) or alkylene oxide adduct thereof.

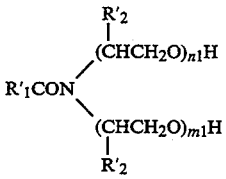

(II)

wherein R′ represents $C_{10}$-$C_{20}$ alkyl or alkenyl, $R'_2$ represents H or $CH_3$, $n_1$ is integer of 1 to 3, $m_1$ is integer of 0 to 3.

(7) Fatty acid esters which are derived from $C_{10}$-$C_{20}$ (average) fatty acid and polyol (glycerine, sorbitol, sorbitan, pentaerythritol, sucrose), or polyalkylene oxide adduct thereof.

(8) Alkylamine oxide of the formula (III)

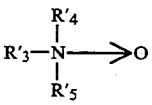

(III)

wherein $R'_3$ represents $C_6$-$C_{20}$ alkyl or alkenyl, $R'_4$ represents $C_1$-$C_3$ alkyl, hydroxyalkyl or polyoxyethylene chain having 2–7 moles of ethylene oxide, $R'_5$ is the same group as R′3 or $R'_4$.

(9) Alkylglycoside of the formula (IV)

$$R'_6(OR'_7)_xG_y \quad \text{(IV)}$$

wherein $R'_6$ represent straight or branched $C_8$-$C_{18}$ alkyl, alkenyl or alkylphenyl, $R'_7$ represents $C_2$-$C_4$ alkylene, G represents a radical derived (originated) from aldose having from 5 to 6 carbons. X is 0–5 on average, preferably 0–2, y is 1–10 on average, preferably 1.1–3. Aldose having from 5 to 6 carbons includes glucose, fructose, maltose and sucrose.

(10) Polyethylene oxide adduct of polypropylene glycol, of which the molecular weight of propylene glycol is 1000–4000 and the average number of polyethylene oxide addition is 10–60.

Usually, those nonionic surfactants (a) having HLB of 6–19, preferably 8–17, are used. Among these, nonionic surfactants of groups (1), (2), (8) and (9) are preferable because of their detergency.

The amount of the nonionic surfactant (a) in the detergent composition is in the range of 10 to 70 wt. %, preferably 15 to 40 wt. %.

$C_8$-$C_{22}$ saturated or unsaturated fatty acids or salts thereof can be illustrated as fatty acids or salts thereof which are (b) ingredients of the present invention. Among specific examples are coconut fatty acid, palm fatty acid, palm core fatty acid, and alkali metal salt, ammonium salt and alkanolamine salt thereof can be illustrated.

The amount of the (b) ingredient in the detergent composition is in the range of 2 to 20 wt. %, preferably 2 to 15 wt. %.

If the amount of the (b) ingredient is less than 2 wt. %, the detergent composition does not have sufficient detergency against muddy dirt. If the amount of the (b) ingredient is more than 20 wt. %, a soap-like odor remains on clothing after washing.

As the (c) ingredient of the present invention, sulfosuccinic amide of the formula (I) can be used. Among these, the compound of the formula (I) wherein $R_1$ is $C_{10}$-$C_{18}$, preferably $C_{10}$-$C_{14}$ alkyl, R2 is a hydrogen atom or $C_1$-$C_3$ alkyl, preferably methyl group, are preferred. Examples include disodium-N-lauryl sulfosuccinic amide, dosodium-N-stearyl sulfosuccinic amide, disodium-N-lauryl-N-methyl sulfosuccinic amide, disodium-N-oleyl sulfosuccinic amide, dimagnesium-N-lauryl sulfosuccinic amide, diammonium-N-lauryl sulfosuccinic amide, etc.

These compounds are described in U.S. Pat. No. 4,790,856. They are commercially available as Alkasurf SS-TA and Alkasurf SS-OA from Alkaril Chemicals. They can be obtained by reacting maleic anhydride with alkylamine to get amide, and sulfonating the amide with sodium sulfide The amount of (c) ingredient in the composition is in the range of 1 to 40 wt. %, preferably 5 to 30 wt. %. If the amount of the (c) ingredient is less than 1 wt % the composition does not have a sufficient detergency effect against the inorganic dirt. If the amount of the (c) ingredient is more than 40 wt. %, antire-deposition action against carbon decreases. In other words, dirt removed by washing can be redeposited on the clothing, particularly during washing and rinsing, if the amount of ingredient (c) exceeds about 40 wt. %.

Detergency against other inorganic dirt such as carbon black can be enhanced by incorporating an anionic surfactant as an ingredient (d) into the detergent composition of the present invention.

Preferable anionic surfactants (d) are illustrated below.

(1) Straight or branched alkylbenzene sulfonate having $C_{10}$-$C_{16}$ (average) alkyl group.

(2) Alkyl or alkenyl ether sulfate having straight or branched $C_{10}$-$C_{20}$ (average) alkyl or alkenyl group, and added with 0.5–8 moles (average) of ethylene oxide, propylene oxide, butylene oxide, ethylene oxide/propylene oxide (ratio=0.1/9.9–9.9/0.1 or ethylene oxide/butylene oxide (ratio=0.1/9.9–9.9/0.1.

(3) Alkyl or alkenyl sulfate having $C_{10}$-$C_{20}$ (average) alkyl or alkenyl group.

(4) Olefin sulfonate having $C_{10}$-$C_{20}$ (average).

(5) Alkane sulfonate having $C_{10}$-$C_{20}$ (average).

(6) α-sulfo fatty acid salt or ester salt of the following formula

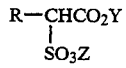

wherein Y represents $C_1$-$C_3$ alkyl or a counter ion, Z is a counter ion. R represents $C_{10}$-$C_{20}$ alkyl or alkenyl group. Examples of counter ions include alkali metal, alkaline earth metal and alkanol amine.

Among these, anionic surfactants of groups (1), (2), (4) and (5) are especially preferable.

Various components other than (a), (b), (c) and (d) can be incorporated into the present detergent composition unless the component impedes the performance of the invention so as to make the composition an aqueous fluid, a non-aqueous fluid, paste, a powder or a bar detergent.

Components which can be incorporated are illustrated below.

(1) Hydrotrope ethanol, ethylene glycol, propylene glycol, propanol, lower alkylbenzene sulfonate such as p-toluenesulfonate, benzoic acid, urea, etc.
(2) Chelating agent zeolite, citric acid salt, citrate, ethylenediamine tetraacetate, nitrilo triacetate, layered silicate, tripolyphosphate, etc.
(3) Alkali agent sodium carbonate, potassium carbonate, sodium silicate, alkanol amine, etc.
(4) Filler water, sodium sulfate, etc.
(5) Enzyme amylase, protease, cellulase, lipase, etc.
(6) Dispersing agent acrylic acid polymer, maleic acid polymer polyethylene glycol, carboxymethyl cellulose, etc.
(7) Bleaching agent sodium percarbonate, sodium perborate, etc.
(8) Others fluorescence dye, perfume, colorant, preservative, etc.

EXAMPLE

The present invention is described in detail by way of the following examples. The present invention, however, is not limited to these examples.

Various detergent compositions shown in Table 1 were prepared, and were respectively evaluated with respect to their detergency by methods described below.

Cloth soiled with mud (artificially soiled cloth)

Kanuma Akadama soils for horticultural use was dried at 120° C.±5° C. for 4 hours and pulverized. After passed through 150 Mesh (100 μm) sieve and dried 120° C.±5° C. for 2 hours, 150 g of the soil was dispersed in 1 l of perchloroethylene.

After muslin #2023 cloth was dipped in the perchloroethylene solution, the cloth was brushed to remove the solution and excess dirt attached (refer to Japanese Laid-Open No. 55-26473).

Cloth soiled with sebum and carbon (artificially soiled cloth)

| *Model composition of sebum and carbon dirt | |
|---|---|
| Carbon black | 15% |
| Cottonseed oil | 60% |
| Cholesterol | 5% |
| Oleic acid | 5% |
| Palmitic acid | 5% |
| Liquid paraffin | 10% |

One kg of the above composition was dispersed in 80 l of perchloroethylene. Muslin #2023 cloth was dipped in the perchloroethylene solution to be soiled and was dried to remove perchloroethylene.

Washing condition and evaluation method

Five pieces of cotton cloth (10 cm ×10 cm) soiled with mud or sebum/carbon were respectively put into 1 l detergent aqueous solution, and then washed in Terg-O-Tometer with 100 rpm. Washing conditions are as following

WASHING CONDITION

| | |
|---|---|
| Washing time | 10 minutes |
| Concentration of detergent | 0.133% |
| Hardness of Water | 4° |
| Water temperature | 20° C. |
| Rinse | 5 min. with city water |

Reflective coefficients of an original cloth before being artificially soiled, a soiled cloth before washing and a soiled cloth after washing were measured by self-record colorimeter (manufactured by Shimazu Ltd.) at 460 μm.

Detergency was evaluated by means of detergency coefficient calculated by the following formula.

Detergency coefficient (%) =

$$\frac{\text{reflective coefficient after washing} - \text{reflective coefficient before washing}}{\text{reflective coefficient or original cloth} - \text{reflective coefficient before washing}} \times 100$$

What is claimed as new and desire to be secured by letters patent of the United States is:

1. A detergent composition which comprises 15–40% by weight of (a) at least one nonionic surfactant selected from the group consisting of polyoxyethylene alkyl ethers, polyoxyethylene alkylphenyl ethers and alkyl glycosides, 2–15% by weight of (b) fatty acid having 8–22 carbon atoms or salt thereof, and 5–20% by weight of (c) sulfosuccinic amide of the formula (I)

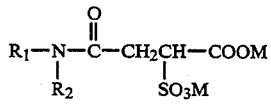

wherein $R_1$ is $C_6$-$C_{22}$ alkyl or alkenyl, $R_2$ is hydrogen, $C_1$-$C_3$ alkyl, carboxylalkyl having $C_1$-$C_3$ alkyl or 1,2-dicarboxyalkyl having $C_1$-$C_3$ alkyl, M is alkali metal, alkaline earth metal, alkanolamine or ammonium, and the balance, water.

2. A detergent composition which comprises 15–40% by weight of (a) at least one nonionic surfactant selected from the group consisting of polyoxyethylene alkyl ethers, polyoxyethylene alkylphenyl ethers and alkyl glycosides, 2–15% by weight of (b) fatty acid having 8–22 carbon atoms or salt thereof, 5–20% by weight of (c) sulfosuccinic amide of the formula (I)

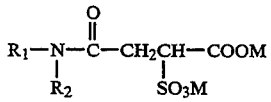

wherein $R_1$ is $C_6$-$C_{22}$ alkyl or alkenyl, $R_2$ is hydrogen, $C_1$-$C_3$ alkyl, carboxylalkyl having $C_1$-$C_3$ alkyl or 1,2-dicarboxyalkyl having $C_1$-$C_3$ alkyl, M is alkali metal, alkaline earth metal, alkanolamine or ammonium, and 5–30% by weight of (d) anionic surfactant.

3. The composition of claim 2, wherein said anionic surfactant is at least one surfactant selected from the group consisting of alkylbenzene sulfonates, polyoxyethylene alkyl ether sulfates, olefin sulfonates and alkane sulfonates.

TABLE 1

| | Example | | | | | | | | | Comparative | | | | | | |
|---|---|---|---|---|---|---|---|---|---|---|---|---|---|---|---|---|
| Constituent (weight %) | 1 | 2 | 3 | 4 | 5 | 6 | 7 | 8 | 9 | 10 | 11 | 12 | 13 | 14 | 15 | 16 |
| (a) polyoxyethylene (EO p = 7) lauryl ether | 30 | 30 | 30 | 30 | 20 | | | 15 | | 25 | 40 | 30 | 20 | 30 | | 32 |
| polyoxyethylene (EO p = 2) nonylphenyl ether | | | | | | 35 | | | 15 | | | | | | | |
| lauryl diglycoside | | | | | | | 40 | | | | | | | | | |
| (b) coconut fatty acid | 3 | 5 | 10 | 15 | | | | | | | 10 | | | | | |
| oleic acid | | | | | 10 | 5 | 2 | 10 | 10 | 5 | | | 10 | 5 | 10 | |
| (c) formula (I) $R_1$ = coconut alkyl $R_2$ = H, M = Na | 17 | 15 | 10 | 5 | | | 8 | 15 | | 15 | | 20 | | | 10 | 6 |
| formula (I) $R_1$ = coconut alkyl $R_2$ = $CH_3$, M = Na | | | | | | 10 | | | | | | | | | | |
| formula (I) $R_1$ = $C_{12}$, $R_2$ = H, M = monoethanolamine | | | | | 20 | | | | 10 | | | | | | | |
| (d) sodium laurylbenzene sulfonate | | | | | | | | 10 | | 5 | | | 20 | | 30 | 6 |
| sodium polyoxyethylene (EOp = 2) lauryl sulfate | | | | | | | | | 15 | | | | | 15 | | |
| hydrogenated tallow alkyl trimethyl ammonium chloride | | | | | | | | | | | | | | | | |
| monoethanolamine | 0.9 | 1.4 | 2.8 | 4.2 | 2.2 | 1.1 | 0.5 | 2.2 | 2.2 | 1.1 | 2.8 | | 2.2 | 1.1 | 2.2 | |
| propylene glycol | 10 | 10 | 10 | 10 | 10 | 10 | 10 | 10 | 10 | 10 | 10 | 10 | 10 | 10 | 10 | 10 |
| water | B* | B | B | B | B | B | B | B | B | B | B | B | B | B | B | B |
| detergency (%) | | | | | | | | | | | | | | | | |
| mud | 67 | 67 | 65 | 64 | 68 | 67 | 64 | 66 | 67 | 68 | 45 | 58 | 57 | 45 | 55 | 57 |
| sebum/carbon | 66 | 67 | 66 | 67 | 65 | 67 | 65 | 71 | 71 | 71 | 67 | 60 | 65 | 67 | 57 | 65 |

*B: abbreviation of balance amount

EOp: abbreviation of average molar number of ethylene oxide adducted.

4. A detergent composition which consists essentially of 15–40% by weight of (a) at least one nonionic surfactant selected from the group consisting of polyoxyethylene alkyl ethers, polyoxyethylene alkylphenyl ethers and alkyl glycosides, 2–15% by weight of (b) fatty acid having 8–22 carbon atoms or salt thereof, and 5–20% by weight of (c) sulfosuccinic amide of the formula (I)

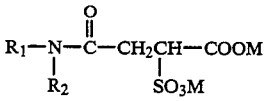

wherein $R_1$ is $C_6$-$C_{22}$ alkyl or alkenyl, $R_2$ is hydrogen, $C_1$-$C_3$ alkyl, carboxylalkyl having $C_1$-$C_3$ alkyl or 1,2-dicarboxyalkyl having $C_1$-$C_3$ alkyl, M is alkali metal, alkaline earth metal, alkanolamine or ammonium, and the balance, water.

5. A detergent composition which consists essentially of 15–40% by weight of (a) at least one nonionic surfactant selected from the group consisting of polyoxyethylene alkyl ethers, polyoxyethylene alkylphenyl ethers and alkyl glycosides, 2–15% by weight of (b) fatty acid having 8–22 carbon atoms or salt thereof, 5–20% by weight of (c) sulfosuccinic amide of the formula (I)

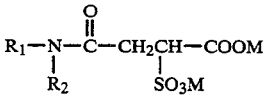

wherein $R_1$ is $C_6$-$C_{22}$ alkyl or alkenyl, $R_2$ is hydrogen, $C_1$-$C_3$ alkyl, carboxylalkyl having $C_1$-$C_3$ alkyl or 1,2-dicarboxyalkyl having $C_1$-$C_3$ alkyl, M is alkali metal, alkaline earth metal, alkanolamine or ammonium, and 5–30% by weight of (d) anionic surfactant.

* * * * *